United States Patent [19]

Koba

[11] Patent Number: 4,653,197

[45] Date of Patent: Mar. 31, 1987

[54] METHOD AND APPARATUS FOR REMOVING MOISTURE IN VENEER

[75] Inventor: Yoshinori Koba, Ohbu, Japan

[73] Assignee: Meinan Machinery Works, Inc., Japan

[21] Appl. No.: 884,171

[22] Filed: Jul. 9, 1986

Related U.S. Application Data

[63] Continuation of Ser. No. 673,540, Nov. 20, 1984, abandoned.

[51] Int. Cl.[4] ..... F26B 3/06

[52] U.S. Cl. ..... 34/23; 34/155; 34/160

[58] Field of Search ..... 34/23, 155, 160, 191

[56] References Cited

U.S. PATENT DOCUMENTS

| | | | |
|---|---|---|---|
| 2,828,553 | 4/1958 | Jarosz | 34/122 |
| 3,199,213 | 8/1965 | Milligan et al. | 34/160 |
| 3,324,571 | 6/1967 | Stock | 34/160 |
| 3,786,574 | 1/1974 | Finley | 34/155 |

*Primary Examiner*—Albert J. Makay
*Assistant Examiner*—David W. Westphal
*Attorney, Agent, or Firm*—Lowe, Price, Leblanc, Becker & Shur

[57] ABSTRACT

A method and apparatus for removing moisture in a veneer are disclosed. The method comprises jetting a compressed gas against at least either tangential face of a veneer in feeding in order to remove moisture contained within the wood structure of it. The apparatus comprises a feeding mechanism of a veneer, a compressed gas jetting equipment with jetting apertures formed in a continuous or discontinuous manner in the traversing direction with respect to the feeding direction for jetting against at least one face of a veneer in feeding, a gas compressor communicating with the compressed gas jetting equipment, and a veneer supporting member arranged oposite the compressed gas jetting equipment and adapted to support the veneer to be jetted with the compressed gas from the other side of it.

16 Claims, 10 Drawing Figures

METHOD AND APPARATUS FOR REMOVING MOISTURE IN VENEER

This is a continuation of application Ser. No. 673,540, filed Nov. 20, 1984, now abandoned.

BACKGROUND OF THE INVENTION

This invention relates to a method and apparatus for removing moisture contained in a veneer, and more particularly to a method and apparatus for mechanically removing moisture existing in annular tissues of the wood structure (mostly in the vessels and tracheids) of a veneer.

Heretofore, various attempts have been made in order to remove the moisture of a veneer mechanically instead of by vapor drying. One such attempt is disclosed in Japanese Patent Application Early Publication No. 48(1973)-49905 in the name of the present applicant. However, all of the known art suggest to squeezing out the moisture by means of compressing and deforming the veneer. Although they have such advantages as to use only an extremely small energy and short period of time for removing the moisture compared with the vapor drying by means of a dryer, there are such disadvantages as that the veneer is deformed plastically and broken by means of such compressive deformation. That is, in order to increase the amount of removed moisture, it is simultaneously required to increase the ratio of compressive deformation with respect to the veneer. It eventually causes an overload to the wood structure and results in extensive deterioration of the quality of the plywood as a final product. Because of the foregoing, practically, the ratio of the deformation is obliged to be limited and a satisfactory amount of moisture removal is unavailable.

As a result of extensive and intensive research, the inventor has obtained the knowledge that a veneer sheet contains vessels extending therein slantwise along both surfaces thereof. Said vessels have their respective openings in both surfaces.

SUMMARY OF THE INVENTION

It is therefore a general object of the present invention to provide a method and apparatus for removing a moisture in a veneer which can overcome the above disadvantages.

One of the specific objects of the invention is to provide a method for removing moisture contained in the wood structure of a veneer, wherein a compressed gas is jetted under pressure against at least one side of a veneer in feeding on the basis of the inventor's finding.

Another object of the invention is to provide an apparatus for removing moisture of a veneer, wherein the moisture contained in the veneer is mechanically removed by jetting a compressed gas against one of the surfaces of the veneer in feeding.

A further object of the invention is to provide an apparatus for removing the moisture of a veneer, wherein the moisture contained in the veneer is mechanically removed by jetting a compressed gas against both surfaces of the veneer during its feeding.

A still further object of the invention is to provide a method and apparatus which can remove a large amount of moisture from the veneer by using only a low calory and without plastically deforming the veneer.

In order to obtain the above objects and others, there is essentially provided a method for removing moisture in a veneer comprising jetting a compressed gas against at least one surface of a veneer in feeding in order to remove moisture within the wood structure thereof.

There is also provided an apparatus for removing moisture in a veneer comprising a feeding mechanism of a veneer; a compressed gas jetting equipment equipped with jetting apertures formed in the traversing direction with respect to the feeding direction for jetting against at least one surface of a veneer in feeding; a gas compressor communicating with said compressed gas jetting equipment; and a veneer supporting member arranged opposite said compressed gas jetting equipment and adapted to support the veneer to be jetted with said compressed gas from the other side thereof.

There is further provided an apparatus for removing moisture in a veneer comprising a feeding mechanism of of a veneer; a pair of compressed gas jetting equipment arranged opposite each other with the feeding passage interposed therebetween and equipped with jetting apertures traversing the feeding direction in order to jet the compressed gas against both surfaces of a veneer in feeding; and a gas compressor communicating with said pair of gas jetting equipment.

Many other advantages and features of the present invention will become manifest to those versed in the art upon making reference to the detailed description and the accompanying sheets of drawings in which preferred structural embodiments incorporating the principles of the present invention are shown by way of example.

BRIEF DESCRITPION OF THE DRAWINGS

FIGS. 1 through 5, FIG. 8 and FIG. 10 illustrate apparatus for removing moisiture contained in a veneer embodying the present invention wherein;

FIGS. 1 through 4 are front views, partly broken, of the moisture removing apparatus but showing only a box-shaped, compressed air jetting equipment in section;

FIG. 5 is a perspective view of the moisture removing apparatus incorporating a jetting roller therein;

FIG. 8 is a front view, partly broken, of the moisture removing apparatus but showing only a pair of box-shaped, compressed air jetting equipment arranged opposite each other in section;

FIG. 10 is a perspective view of the moisture removing apparatus incorporating a pair of jetting rollers therein.

DETAILED DESCRIPTION OF THE EMBODIMENTS

Preferred embodiments of the present invention will be described hereunder with reference to the accompanying drawings, wherein like numerals denote like or corresponding parts throughout.

Figure 1:
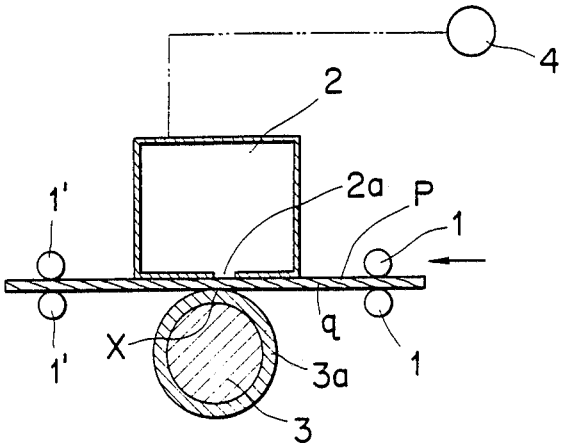

FIG. 1 illustrates an apparatus for removing moisture of a veneer according to a preferred embodiment of the present invention designed to jet a compressed air as a compressed gas against one of the surfaces of a veneer. A veneer P having vessels extending slantwise therein is fed substantially along the vessel direction by a pair of feed rollers 1, 1 and 1'1'. A carrier roller 3 is rotatably mounted beneath the veneer feeding passage by means of said feed rollers. Above said veneer feeding passage, a box-shaped, air compressed jetting equipment is arranged opposite said carrier roller 3. An air compressor 4 is connected to said compressed air jetting equipment 2 for communicating with respect to each other. A jetting aperture 2*a* for jetting the compressed air is formed in the sliding surface of said equipment 2 at the feeding passage side in such a manner as to open up in the perpendicular direction with respect to the feeding direction. Said jetting aperture 2*a* is formed in a slit shape having about the same length as the width of the veneer to be fed. However, said length may be longer or shorter than the width of the veneer. Also, the configuration of the aperture 2*a* may be formed in such a manner as that the opening portion thereof is arranged discontinuously. As shown in the drawing, said jetting aperture 2*a* may be arranged slightly biased to the feeding-in side with respect to the contacting portion X between the carrier roller 3 and the under-surface of the veneer P with the marginal portion of the feeding-out side of the jetting aperture 2*a* positioned above said contacting portion X (more strictly to say, since the peripheral surface of the carrier roller 3 is depressed and said contacting portion X is spread in the feeding direction, it may be better to say "above the marginal portion of the feeding-in side of said contacting portion X"), so that an escaping space for the compressed air is formed at the feeding-in side of said contacting portion X, thereby enabling to normally blow the moisture toward the feeding in side and preventing the moisture from penetrating into the veneer at the feeding-out side again. In other words, the feeding-out side of said jetting aperture 2*a* is in a closed or blocked state, since the carrier roller 3 and the veneer P are contacted as mentioned above. Therefore, the moisture is blown to the feeding-in side with respect to the jetting aperture 2*a* where the escaping space is formed together with the compressed air. Said carrier roller 3 may be of a loose rotating type or driving type. If the carrier roller 3 is covered with a rubber 3*a* at the peripheral surface, the veneer P can be fed by the carrier roller 3 only. Also, since the dimension of said contacting portion X is increased, the effect for preventing the compressed air as well as the moisture content from penetrating into the feeding-out side of the jetting aperture 2*a* is increased.

Figure 2:
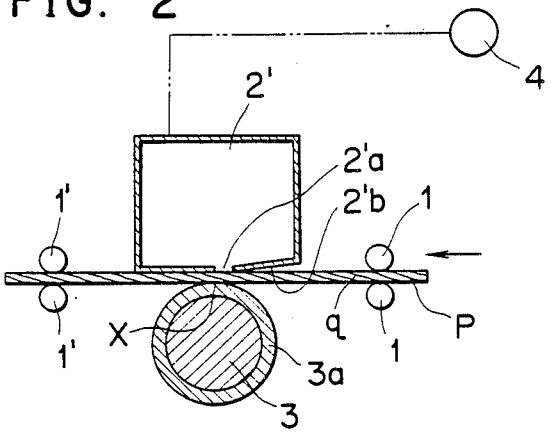
Figure 3:
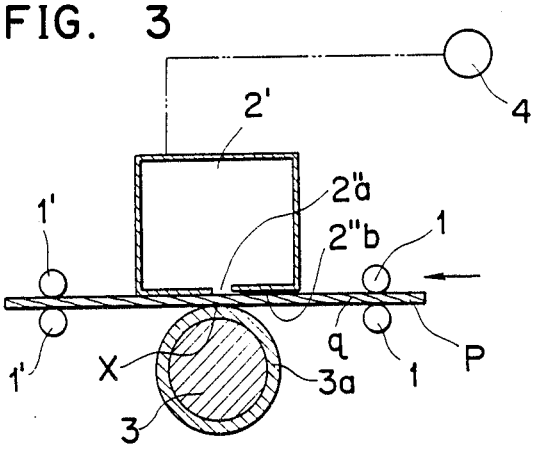

FIG. 2 illustrates the moisture removing apparatus incorporating therein a box-shaped, compressed air jetting equipment 2' formed with an escaping surface 2'*b* for the compressed air at the feeding-in side of the jetting aperture 2'*a* instead of the box-shaped, compressed air jetting equipment 2 of FIG. 1. This escaping surface 2'*b* is formed in order to further increase the effect of said escaping space. The configuration of the escaping surface 2'*b* may be varied depending on various factors such as thickness of the veneer material, feeding speed thereof, pressure of the compressed air, etc. In the illustrated embodiment, the jetting aperture 2'*a* has a width of 2 mm in the feeding direction, and the escaping surface 2'*b* is formed in a gentle slant form. Alternatively, instead of this slant surface 2'*b*, a sliding surface of the jetting aperture 2''*a* at the feeding-in side may be formed in a stepping up form, i.e., flat 2''*b* which is higher by 0.2 mm than the sliding surface of the feeding-out side with the same efffect (refer to FIG. 3).

Figure 4:
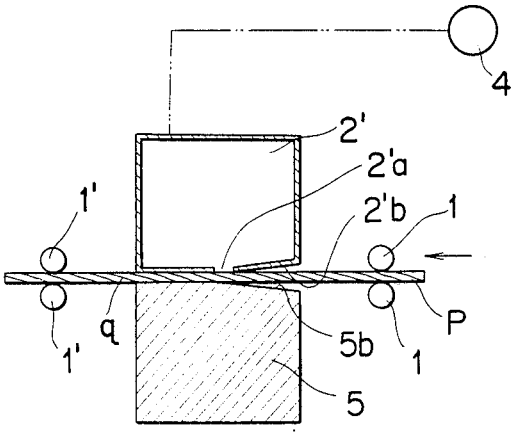

FIG. 4 illustrates another preferred embodiment, wherein a veneer supporting table 5 is employed as a veneer supporting member. In this embodiment, the compressed air jetting equipment 2' is formed with an escaping surface 2'*b* so that an escaping space for the compressed air is formed at the feeding-in side of the jetting aperture 2'*a*. In order to increase the effect of the escaping space, said veneer supporting table 5 is also formed with an escaping surface 5*b*. However, this escaping surface 5*b* is formed in such a manner as to be declined toward the feeding-in side from the marginal portion of the feeding-out side instead of the marginal portion of the feeding-in side of the jetting aperture 2'*b*.

Figure 7:
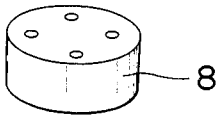
FIG. 7 is a perspective view of a cap to be put on said valve.
Figure 6:
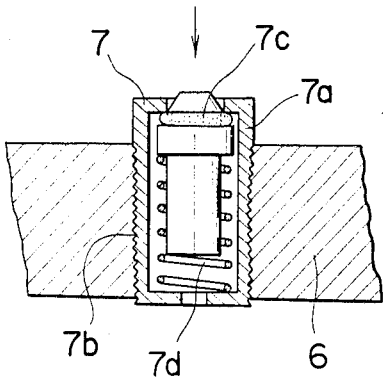
FIG. 6 is a schematic view of a valve screwed tight to the peripheral wall of the jetting roller.
Figure 5:
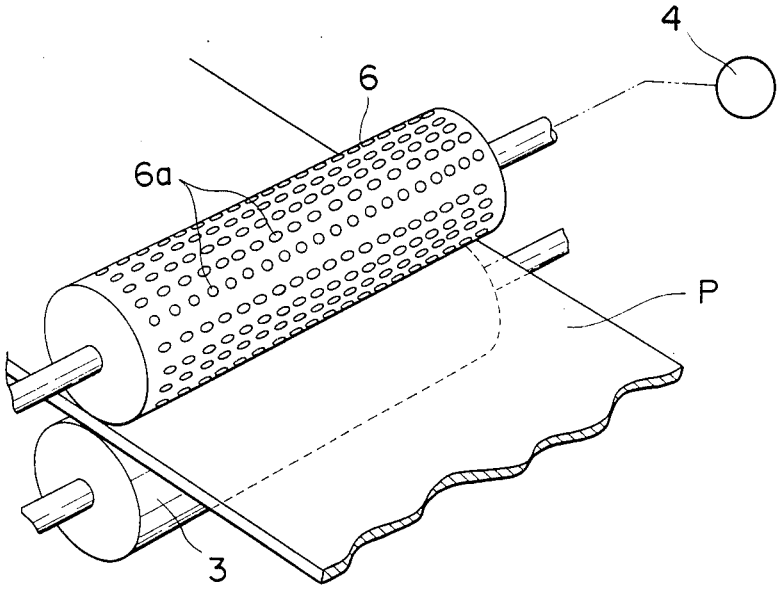

FIG. 5 illustrates a hollow jetting roller 6 equipped with a number of jetting apertures in the peripheral surface thereof which can be used as a substitution of the compressed gas jetting equipments 2, 2' and 2''. Said roller 6 is such constituted as to be rotated in synchronism with the rotation of said carrier roller 3 (or, alternatively in the case where the supporting member for the veneer is a supporting table, in synchronism with the rotation of the feed rollers) by a driving means (not shown). The jetting apertures 6*a* are provided with valves 7 so that the internal compressed gas is jetted therethrough only when an external pressure such as, for example, the contacting with the veneer, is applied. Said valve 7 chiefly comprises, as shown in section in FIG. 6, a cylindrical valve box 7*a*, a valve stem 7*b*, a rubber packing 7*c* attached to the tip portion of said valve stem 7*b* and a spring 7*d* for urgedly contact said rubber packing 7*c* against the valve seat. A number of such valves 7 are screwed tight to suitable positions on the peripheral wall of the roller. When the veneer P is inserted between said jetting roller 6 and said carrier roller 3, these valves 7, more particularly, the tip portions of the valve stems 7*b* are contacted by the face of the veneer P. Then, the valve stems 7*b* are moved inwardly resisting the biasing force of the springs 7*d*. As a result, the compressed air within the roller is jetted outside through gaps of the valve seats. It is preferable to put caps 8 on the respective valves 7 as shown in FIG. 7.

All the other structures are the same as those of FIG. 1 and the identical numerals of FIG. 1 denote identical parts in FIGS. 2 through 5. In the illustrated embodiments in FIGS. 2 through 5, the compressed gas jetting equipments 2, 2', 2'' and 6 are arranged above the feeding passage, and the veneer supporting members 3 and 5 are arranged under the feeding passage, respectively. However, the positional relation between the two may be arranged in the reversed way with respect to the feeding passage. Furthermore, the feeding passage itself may be arranged in the vertical or slant direction and the respective equipments may be arranged at the both sides thereof.

Figure 8:
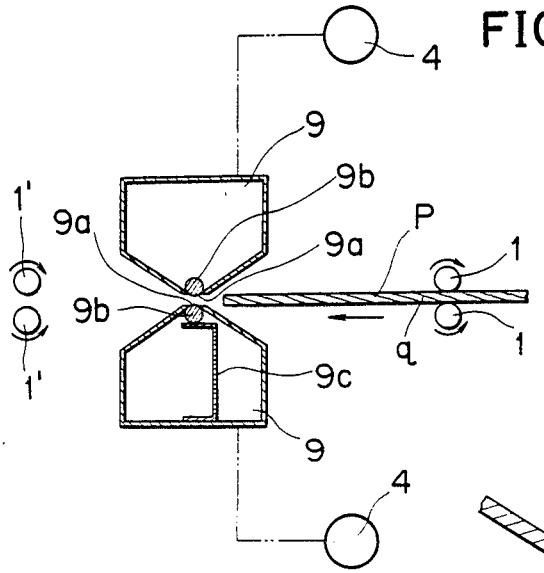
Figure 9:
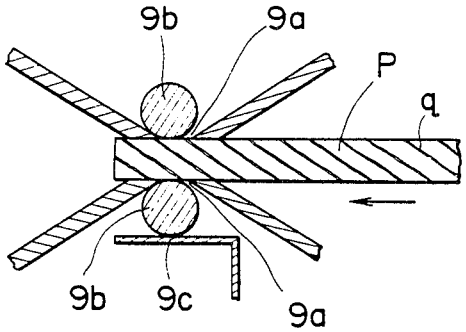
FIG. 9 is a partly enlarged view of the jetting equipments of FIG. 8.
Figure 10:
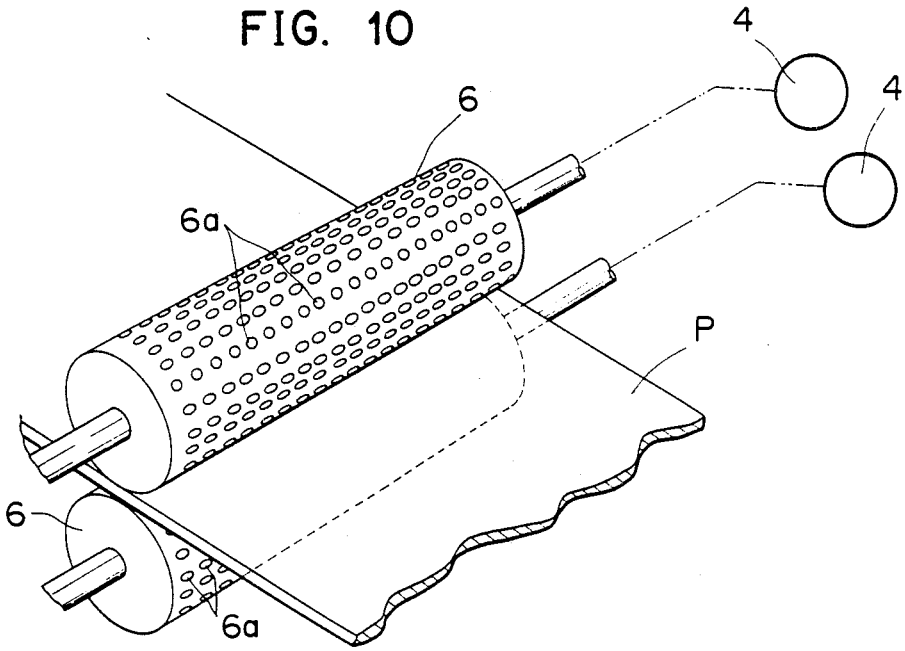

FIGS. 8 through 10 illustrate the third embodiment of the present invention, wherein a pair of compressed air jetting equipments are arranged opposite each other with the feeding passage disposed therebetween in order to jet a compressed air against both surfaces of the veneer in feeding.

In FIG. 8, box-shaped, compressed air jetting equipment 9, each equipped with a jetting aperture 9*a* at the feeding passage side, are arranged opposite each other with a space slightly smaller than the width of the veneer P formed therebetween. Air compressors 4, 4 are arranged in such a manner as to communicate with the respective compressed air jetting equipments 9,9. At the inside of the jetting apertures 9*a* of the compressed air jetting equipments 9, rod-shaped members 9*b* are provided made of a urethane rubber and having sizes larger and slightly longer than the opening portions of said jetting apertures 9a. Particularly, the compressed air jetting equipment at the lower side contains a resilient supporting member 9c of a yoke shape and said rod-shaped member 9b is placed thereon in such a manner as to normally block the jetting aperture 9a (refer to FIG. 8).

In this apparatus, the rod-shaped member 9b is urgedly contacted against the jetting aperture 9a so that the jetting aperture 9a is normally blocked. However, when the veneer P is inserted between the both compressed air jetting equipments 9,9, said rod-shaped member 9b is pushed into the box while being pushed toward the feeding-out side. As a result, a gap is formed between the jetting aperture 9a and the feeding side of the rod-shaped member 9b, thus allowing the compressed air to be jetted outside through said gap.

In FIG. 10, said rotatable jetting rollers 6 (refer to FIGS. 5 and 6) are arranged opposite with respect to each other in the vertical direction as a pair of compressed air jetting equipments. Since the same can be referred to as moisture removing apparatus equipped with a feeding means of the veneer, the description thereof will be omitted.

With the above constitution, when the veneer fed by the feeding mechanism arrives at the compressed gas jetting equipment, the compressed gas is jetted against both of the veneer through said jetting apertures. As a result, the compressed gas is caused to act on the moisture contained in the wood structure such as vessels, rays, etc., thus removing the moisture from the veneer. At this time, when a moisture removing apparatus including only a compressed gas jetting apparatus at one side of the feeding passage is employed, it is preferred that the veneer is subjected to the moisture removing apparatus twice for subjecting the respective surfaces of the veneer to said jetting of the compressed gas. In order to carry the process out simultaneously, it is required to install two such removable apparatus (of course, the compressed gas jetting equipments are arranged alternatively), or to use a moisture removing apparatus equipped with a pair of compressed gas jetting equipments. Regarding the method of inserting the veneer into the apparatus, it is confirmed that a better moisture removing efficiency is obtained when the veneer is inserted between the compressed gas jetting equipment 2 and the carrier roller 3 such that slant vessels q run to receive the gas jet through their openings in the jetting equipment side surface and guide the gas jet out through the openings in the carrier roller side surface and the water content receiving the compressed gas is blown toward the feeding-in side through the vessels. Even if the water content blown onto the feed-in side wets the veneer, it makes no problem since said veneer is to be subjected to the jet. When the moisture removing apparatus equipped with the pair of compressed gas jetting equipments is used as shown in FIGS. 8, 9 and 10, it is not required to assure the state of the veneer vessels as mentioned above, since the compressed air is jetted against both surfaces of the veneer simultaneously. What is required is to merely insert the veneer along the vessel direction and the removed moisture is always conveniently pushed toward the feeding-in side.

When tested using the apparatus shown in FIG. 8, the larch of 3 mm thickness having an initial moisture content of 150% was reduced to a moisture content of about 70%.

Furthemore, if the air to be jetted is heated to a hot air or vapor before use, the resin within the wood structure is also melted by the heat and pushed out of the veneer. As a result, the problems of poor adhesion which often arises at the time when the veneers are bonded together can be solved at the same time. Likewise, if the air or vapor mixed with chemicals such as preservatives, or the vapor of chemicals such a preservatives themselves is sprayed, another process of such chemical treatment can be conveniently omitted. When the air pressure is made higher, that much higher efficiency can be obtained. It is confirmed by test that the limit of practical use is around 3 $kg/cm^2$ (based on 1 $kg/cm^2$ of the atmospheric pressure ) under normal condition.

The application of the present invention will be described next. Before the moisture content is removed according to the present invention, the veneer is formed with cuts or cracks in surfaces thereof. Then, compressed air is fed into the wood structure within the veneer through said cuts or cracks. Said cuts or cracks are made by, for example, an escape roll, blade, needle or the like. The cuts should not be made so deep as to penetrate from the front tangential face to the rear. Also, as described with respect to the formation of the escaping space, the pressure is varied at its feeding-in side and its feeding-out side. More particularly, the pressure at the feeding-in side is made lower than that at the feeding-out side so that the removed moisture is moved more effectively. By applying the differential pressure to a pressure reducing apparatus, it can be carried out compulsorily.

As mentioned in the foregoing, since the present invention is accomplished in view of the fact that almost all veneers which are cut by a veneer lathe have slant vessels with respect to the surfaces and besides the vessels are necessarily opened up in both surfaces of the veneer, and also based on the concept that the moisture contained in the vessels is dried by blowing off, the invention is fundamentally different in the concept compared with the conventional vapor drying by heating. According to the present invention, a large amount of moisture can be removed at low calory. In addition, the apparatus required for the invention can be made small in size, thus contributing to cost reduction and extensive labor saving.

While the present invention has been particularly shown and described in its preferred forms with certain degree of particularity, it will be understood by those skilled in the art that the foregoing and other changes may be made without departing from the spirit and the scope of the invention hereinafter claimed.

What is claimed is:

1. A method of removing moisture from a veneer comprising the steps of feeding a veneer having a first surface and a second surface in a predetermined direction without plastically deforming said veneer, said veneer containing annular tissues extending slantwise therein, each annular tissue having openings in said first and second surfaces, and said predetermined feeding direction being substantially parallel with said annular tissues; and jetting compressed gas against at least one of said surfaces using gas jetting means, said gas jetting means having a gas jetting opening and being in contact with said at least one surface without plastically deforming said veneer or said contacted surface to shield at least a downstream side of said gas jetting opening and blow moisture in said annular tissues in a direction substantially opposite said predetermined direction and substantially parallel with said annular tissues.

2. A method for removing moisture from a veneer according to claim 1, wherein said compressed gas is hot air.

3. A method for removing moisture from a veneer according to claim 1, wherein said compressed gas is vapor.

4. A method for removing moisture from a veneer according to claim 1, wherein the pressure of said compressed gas is at least 3 $kg/cm^2$.

5. An apparatus for removing moisture from a veneer comprising:

a feeding mechanism for a veneer having first and second surfaces for feeding the veneer in a predetermined direction without plastically deforming said veneer, said veneer containing annular tissues extending slantwise therein, each annular tissue having openings in said first and second surfaces, and said predetermined feeding direction being substantially parallel with said annular tissues;

compressed gas jetting equipment including gas jetting means arranged in the traversing direction with respect to the feeding direction for jetting compressed gas against at least one of the surfaces of the veneer in feeding, said gas jetting means having a gas jetting opening and being in contact with said at least one surface without plastically deforming said veneer or said contacted surface to shield at least a downstream side of said gas jetting opening and blow moisture in the annular tissues contained in the veneer in a direction substantially opposite said predetermined direction and substantially parallel with said annular tissues;

a gas compressor in communication with said compressed gas jetting equipment; and a veneer supporting member arranged opposite said compressed gas jetting equipment and adapted to support the veneer to be jetted with said compressed gas from the other surface thereof.

6. An apparatus for removing moisture from a veneer according to claim 5, wherein said gas jetting opening includes apertures formed in a continuous manner.

7. An apparatus for removing moisture from a veneer according to claim 5, wherein said gas jetting opening includes a single outlet formed in a discontinuous manner.

8. An apparatus for removing moisture from a veneer according to claim 5, wherein said jetting equipment comprises a rotatable hollow cylinder formed with a number of jetting opening apertures in the peripheral surface thereof and said gas jetting means further comprises valves for jetting internal compressed gas by means of external pressure through the jetting opening apertures.

9. An apparatus for removing moisture from a veneer according to claim 5, wherein said compressed air jetting equipment comprises a box having an escaping surface at the feeding-in sides of said gas jetting means and a plane surface at the feeding-out sides thereof.

10. An apparatus for removing moisture from a veneer according to claim 5, wherein said veneer supporting member comprises a rotatable carrier roller.

11. An apparatus for removing moisture from a veneer according to claim 5, wherein said veneer supporting member comprises a veneer supporting table having an escaping surface for the compressed gas at the feeding-in sides of said gas jetting means and a plane surface at the feeding-out sides thereof.

12. An apparatus for removing moisture from a veneer comprising:

a feeding mechanism for a veneer having first and second surfaces for feeding the veneer in a predetermined direction along a feeding passage without plastically deforming said veneer, said veneer containing annular tissues extending slantwise therein, each annular tissue having openings in said first and second surfaces, and said predetermined feeding direction being substantially parallel with said annular tissues;

a pair of compressed gas jetting equipments arranged opposite each other with said feeding passage located therebetween and including gas jetting means traversing the feeding direction for jetting compressed gas against both surfaces of said veneer, each of said jetting means having a gas jetting opening and being in contact with the adjacent veneer surface without plastically deforming said veneer or said contacted surface to shield at least a downstream side of said gas jetting opening and blow moisture in the annular tissues contained in the veneer in a direction substantially opposite said predetermined direction and substantially parallel with said annular tissues; and a gas compressor in communication with said pair of gas jetting equipments.

13. An apparatus for removing moisture from a veneer according to claim 12, wherein said gas jetting opening includes a single outlet formed in a continuous manner.

14. An apparatus for removing moisture from a veneer according to claim 12, wherein said gas jetting opening includes apertures formed in a discontinuous manner.

15. An apparatus for removing moisture from a veneer according to claim 12, wherein said pair of compressed gas jetting equipments comprise a pair of rotatable hollow roller formed with a number of jetting opening apertures in the peripheral surfaces thereof and said jetting opening apertures are provided with valves for jetting internal compressed gas through the jetting opening apertures by the external pressure.

16. An apparatus for removing moisture from a veneer according to claim 12, wherein said pair of compressed gas jetting equipments comprises a pair of boxes having escaping surfaces for the compressed gas at the feeding-in sides of said jetting apertures and plane surfaces at the feeding-out sides thereof.

* * * * *